US009959758B2

(12) United States Patent
Magnusson et al.

(10) Patent No.: US 9,959,758 B2
(45) Date of Patent: May 1, 2018

(54) METHOD AND SYSTEM FOR LOCATING A PARKED VEHICLE

(71) Applicant: VOLVO CAR CORPORATION, Gothenburg (SE)

(72) Inventors: Klara Magnusson, Gothenburg (SE); Anders Ryberg, Saro (SE)

(73) Assignee: Volvo Car Corporation, Gothenburg (SE)

( * ) Notice: Subject to any disclaimer, the term of this patent is extended or adjusted under 35 U.S.C. 154(b) by 0 days. days.

(21) Appl. No.: 15/294,894

(22) Filed: Oct. 17, 2016

(65) Prior Publication Data

US 2017/0116855 A1 Apr. 27, 2017

(30) Foreign Application Priority Data

Oct. 23, 2015 (EP) ..... 15191200

(51) Int. Cl.

| | |
|---|---|
| ***G08G 1/123*** | (2006.01) |
| ***G08G 1/13*** | (2006.01) |
| ***E04H 6/08*** | (2006.01) |
| ***G08G 1/14*** | (2006.01) |
| ***G08G 1/00*** | (2006.01) |

(52) U.S. Cl.

CPC ..... *G08G 1/13* (2013.01); *E04H 6/08* (2013.01); *G08G 1/142* (2013.01); *G08G 1/144* (2013.01); *G08G 1/146* (2013.01); *G08G 1/205* (2013.01)

(58) Field of Classification Search

CPC ..... G08G 1/13; G08G 1/205; E04H 6/08; B60R 25/33

See application file for complete search history.

(56) References Cited

U.S. PATENT DOCUMENTS

| | | | | |
|---|---|---|---|---|
| 9,086,285 | B2 * | 7/2015 | Gupta | G08G 1/205 |
| 2002/0171562 | A1 | 11/2002 | Muraki | |
| 2005/0280555 | A1 * | 12/2005 | Warner, IV | G08G 1/14 340/932.2 |
| 2015/0057926 | A1 | 2/2015 | Gupta et al. | |
| 2015/0154540 | A1 | 6/2015 | Skaaksrud | |

FOREIGN PATENT DOCUMENTS

| | | | |
|---|---|---|---|
| EP | 1256782 | A1 | 11/2002 |
| WO | 2015124472 | A1 | 8/2015 |

OTHER PUBLICATIONS

Extended European Search Report dated Apr. 22, 2016, Application No. 15191200.3-1810—Applicant Volvo Car Corporation, 9 Pages.

* cited by examiner

*Primary Examiner* — John A Tweel, Jr.
(74) *Attorney, Agent, or Firm* — Brooks Kushman P.C.

(57) ABSTRACT

The present disclosure relates to a method performed by a vehicle locating system for locating at least a first parked vehicle situated where it potentially is difficult to find. The system determines an estimated geographical vehicle position of the at least first parked vehicle. The system furthermore determines—based on digital map data—that the estimated vehicle position is comprised in, or is in in the vicinity of, a multilevel parking area. Moreover, the system transmits a level request message to a user device associated with the at least first parked vehicle. The disclosure also relates to a vehicle locating system in accordance with the foregoing, and a computer program product comprising a computer program containing computer program code means arranged to cause a computer or a processor to execute the steps of the vehicle locating system discussed above, stored on a computer-readable medium or a carrier wave.

17 Claims, 3 Drawing Sheets

METHOD AND SYSTEM FOR LOCATING A PARKED VEHICLE

CROSS-REFERENCE TO RELATED APPLICATIONS

This application claims foreign priority benefits under 35 U.S.C. § 119(a)-(d) to European patent application number EP 15191200.3, filed Oct. 23, 2015, which is incorporated by reference in its entirety.

TECHNICAL FIELD

The present disclosure relates to a vehicle locating device system and a method performed therein for locating at least a first parked vehicle situated where it potentially is difficult to find.

BACKGROUND

In recent years, an increasing activity of shopping over the Internet has, among other reasons, led to a desire for alternative, refined package delivery points for consumers. Instead of having to pay a visit to a post office, or stay at home in order to receive a package delivery, a recipient of a package may be given the opportunity to have said package delivered to, for instance, a self-service package delivery service such as e.g., a pick-up locker. In order to retrieve the package, the locker may be opened with a pick-up code unique to the recipient.

For even greater convenience, the recipient of a package may nowadays even be able to choose to have said package delivered directly to his or her parked, unattended vehicle. Giving the delivery service temporary access to the vehicle—for instance via diagnostic technology—to deposit e.g., a package, the vehicle may act as a "smart locker" for package drop-off WO 2015/124472, for instance, relates to addressing and identifying vehicles adapted for receipt of a delivered service while being unattended. Disclosed therein is a solution according to which it is determined whether at least a first nearby vehicle is in the vicinity of a service provider adapted to carry out a delivered service to the nearby vehicle, and which at least first nearby vehicle then is requested to announce itself. Accordingly, the approach disclosed enables the service provider to more easily find one or more vehicles about to receive a delivery of a delivered service from the service provider. However, although the solution suggested by WO 2015/124472 provides an improved manner of identifying and locating such a vehicle, finding the vehicle may nevertheless be difficult should the vehicle have parked in a multilevel parking area where distinguishing between different parking levels may pose a challenge.

SUMMARY

It is therefore an object of embodiments herein to provide an improved approach of identifying—and subsequently determining a more precise position—of a parked vehicle situated where it may be difficult to find, e.g., a vehicle parked in a multilevel parking area which vehicle further may be adapted for receipt of a delivered service.

According to a first aspect of embodiments herein, the object is achieved by a method performed by a vehicle locating system for locating at least a first parked vehicle situated where it potentially is difficult to find. The vehicle locating system determines an estimated geographical vehicle position of the at least first parked vehicle. The vehicle locating system furthermore determines—based on digital map data—that the estimated vehicle position is comprised in, or is in in the vicinity of, a multilevel parking area. Moreover, the vehicle locating system transmits a level request message and optionally a request for a position on a particular level, such as a request for a parking space number, to a user device associated with the at least first parked vehicle.

Thereby, by introducing a method performed by a vehicle locating system for locating at least a first parked vehicle situated where it potentially is difficult to find, for instance a vehicle parked in a multilevel parking area and further for instance adapted for receipt of a delivered service while being unattended, an approach is provided which supports finding one or more parked vehicles which e.g., vertical parking position(s) may be challenging to determine, and optionally as well as the actual position of a vehicle on a particular level. That is, since the vehicle locating system determines an estimated geographical vehicle position of the at least first parked vehicle, an approximate vehicle position of the at least first parked vehicle is established. Then, since the vehicle locating system furthermore determines—based on digital map data—that the estimated vehicle position is comprised in, or is in in the vicinity of, a multilevel parking area, it is established by comparison of the determined estimated position of the parked vehicle to a multilevel parking area identified in digital map data, that said estimated vehicle position is within, or close to, a parking area having more than one parking level, and thus that the vehicle is deemed situated in an area where said vehicle may be challenging to find. Furthermore, since the vehicle locating system then transmits a level request message to a user device associated with the at least first parked vehicle, a respective message may be submitted to each of a user device of the one or more vehicles parked in—or in the vicinity of—the multilevel parking area, which message requests information related to on which parking level the associated vehicle is parked, and optionally the position of the vehicle on a particular level.

For that reason, an improved approach is provided for identifying—and subsequently determining a more precise position—of a parked vehicle situated where it may be difficult to find, e.g., a vehicle parked in a multilevel parking area which vehicle further may be adapted for receipt of a delivered service.

The technical features and corresponding advantages of the above mentioned method will be discussed in further detail in the following.

By introducing a method performed by a vehicle locating system for locating at least a first parked vehicle situated where it potentially is difficult to find, an approach is provided which supports finding one or more parked vehicles which e.g., vertical parking position(s) may be challenging to determine. "Locating" may refer to "identifying" and/or "finding". According to exemplifying embodiments herein, "locating" may further refer to "determining a location of", "determining with greater accuracy a location of", "determining a vertical location of" and/or "determining a parking level of". Moreover, "vehicle" may refer to any arbitrary vehicle, for instance a car, truck, lorry, van, bus, motorcycle etc. The vehicle may further comprise, or have on-board, a commonly known positioning system, such as a global positioning system, navigation system or the like.

The "vehicle locating system" may, for instance, be implemented in one or several servers and/or in one or several clouds, and may be adapted to communicate, e.g., wirelessly, with the at least first vehicle. Such a communication may for instance take place directly with the vehicle, and/or via an intermediate system adapted to wirelessly communicate with vehicles, remotely control functionality of the vehicles, and/or hold updated positions and/or information associated with the vehicles; for instance a management and/or assisting system such as e.g., Volvo On Call.

According to an example, the introduced method performed by the vehicle locating system is for locating at least a first parked vehicle adapted for receipt of a delivered service while being unattended, situated where it potentially is difficult to find. In such a scenario, an approach is provided which supports finding the vehicle(s) which parking position(s)—e.g., vertical parking position(s)—may be challenging to determine, to subsequently facilitate a potential delivery of a delivered service. Such a delivery, which reaches beyond the scope of this disclosure, may for instance take place by enablement of temporary access to the vehicle, as commonly known in the art.

The expression "vehicle adapted for receipt of a delivered service while being unattended" is throughout this disclosure intended to at least refer to an arbitrary vehicle which, in a known manner, is or may be pre-configured to give temporary access to the vehicle, or e.g., to a trunk thereof, to a service provider, to be able to receive the delivered service. The vehicle being "unattended" may refer to the vehicle being, for instance, parked and locked, without the driver, owner, passenger or any arbitrary person accountable for the vehicle, being present. It should be noted, that in a scenario when the e.g., person accountable for the vehicle happens to be present in the vehicle, although such a scenario is neither necessary nor intended, said delivered service may nonetheless be received. Furthermore, the referred to "delivered service" which the one or more vehicles may be adapted to receive, may vary from one vehicle to another, and may for instance relate to delivery of a product, such as e.g., a parcel, goods, dry cleaned clothes, food etc., or delivery of a service, such as e.g., a vehicle service, vehicle reconditioning or the like. Accordingly, the expression "service provider" may throughout this disclosure refer to any arbitrary service entity and/or service person providing delivered services. That is, the "service provider" may at least refer to a service entity providing delivered services according to the foregoing, for instance a vehicle carrying deliveries such as a car, scooter, bicycle or van, or for instance, a service vehicle carrying equipment necessary to service the vehicle destined therefore. The "service provider" may as a complement include an operator performing the delivered service, such as e.g., a delivery man, mechanic, or the like.

Since the vehicle locating system determines an estimated geographical vehicle position of the at least first parked vehicle, an approximate vehicle position of the at least first parked vehicle is established. The estimated position of the vehicle—which for instance may be based on global coordinates—may be determined automatically, for instance when it is determined that the at least first vehicle has been parked; additionally or alternatively the estimated position of the vehicle may be determined on request, for instance prior to a scheduled service delivery to the at least first vehicle, for instance approximately 0.1-5 hours prior thereto. The vehicle position may, at least partly, be estimated in any arbitrary manner, for instance with support from commonly known positioning techniques, such as global positioning techniques, and/or sensor techniques commonly provided in vehicles, and the estimated vehicle position subsequently be derived by—and/or provided to—the vehicle locating system. The estimated vehicle position may, for instance, be derived directly from the at least first vehicle, and/or from the intermediate system discussed above. Thus, the estimated vehicle position may be derived at a current instant in time; additionally and/or alternatively, a stored estimated vehicle position value may be derived, e.g., from a database holding vehicle position values, which database for instance may be comprised in said intermediate system. The expression of determining an estimated geographical "vehicle position" may refer to determining an estimated geographical "horizontal vehicle position". Moreover, "determining" an estimated geographical vehicle position, may for instance refer to "deriving", "accessing", "fetching", "retrieving", "reading", "receiving", and/or "requesting and receiving" an estimated geographical vehicle position.

Since the vehicle locating system furthermore determines—based on digital map data —that the estimated vehicle position is comprised in, or is in in the vicinity of, a multilevel parking area, it is established by comparison of the determined estimated position of the parked vehicle to a multilevel parking area identified in digital map data, that said estimated vehicle position is within, or close to, a parking area having more than one parking level. Accordingly, the at least first parked vehicle is deemed situated in an area where said vehicle may be challenging to find. That is, an accuracy of a determined estimated vehicle position is commonly, to great extent, satisfying in the horizontal plane; however, positioning a vehicle vertically, e.g., on which parking level the vehicle is situated and/or distinguishing between different parking levels, may pose a challenge. Thus, by for instance determining based on digital map data which one or more vehicles out of a plurality of vehicles—for instance adapted for receipt of a respective delivered service—that are comprised in, or in the vicinity of, a multilevel parking area, vehicles which are deemed to be situated in an area where they may be difficult to find, are identified. It may be noted that more than one parked vehicle may be determined to have an estimated vehicle position comprised in, or in the vicinity of, a multilevel parking area. Concurrently, another scenario may be that none of estimated vehicle positions of one or more parked vehicles are determined to be comprised in, or be in the vicinity of, a multilevel parking area, should said one or more vehicles be parked a distance considered far away enough from the multilevel parking area. Moreover, the digital map data may comprise more than one multilevel parking area.

The expression "parking area" may refer to "parking garage", "car park" and/or "parking facility". Moreover, "multilevel parking area" may refer to "multi-story parking area" and/or "parking area comprising more than one parking level". The parking levels may be arbitrarily arranged, for instance aligned on top of one another, e.g., in parallel with the ground. Additionally or alternatively, one or several of the parking levels may be arranged to have an inclination as compared to the ground. The expression "in the vicinity of" may throughout this disclosure for instance refer to "nearby", "close to", "in the surroundings of", "within a same region and/or geographical area as" and/or "within a maximum distance from". Said maximum distance may be arbitrary selected, for instance being represented by 1, 10 or 100 meters. What is considered to be "in vicinity" of the multilevel parking area may vary with e.g., a confidence level of the determined estimated vehicle position of the at least first parked vehicle; the more reliable the determined estimated vehicle position is deemed to be, the shorter may the maximum distance be, and vice versa.

Moreover, "digital map data" may refer to "geographical data", and may for instance be comprised in one or more of a memory, server, database and/or cloud; for instance in a digital map database from which map data covering the multilevel parking area may be derived. "Determining" based on digital map data may in this context refer to "deriving" and/or "calculating" based on digital map data. Furthermore, "based on" digital map data, may refer to "utilizing", "considering" and/or "taking into account" digital map data and/or geographical data.

According to an example, determining—based on digital map data—that the estimated vehicle position is comprised in, or is in in the vicinity of, a multilevel parking area, may comprise comparing the determined estimated position of the parked vehicle to a multilevel parking area identified in digital map data, and determining that said estimated vehicle position is comprised in, or is in the vicinity of, the multilevel parking area. The multilevel parking area may, for instance, be identified in that the digital map data associated therewith may comprise an identifier distinguishing the multilevel parking area from other areas and/or objects covered in the digital map data. For instance, said identifier may comprise one or more of a property, attribute, content or the like, pinpointing and/or marking the multilevel parking area as such.

Since the vehicle locating system transmits a level request message to a user device associated with the at least first parked vehicle, a respective message may be submitted to each of a user device of the one or more vehicles parked in—or in the vicinity of—the multilevel parking area, which message requests information related to on which parking level the associated vehicle is parked. Accordingly, said message is submitted only to user devices of vehicles determined to be parked in—or in the vicinity of—a multilevel parking area, as these vehicles are considered to be parked within or near an area where they may be difficult to find. This means that said message is not submitted to user devices of vehicles determined to be parked a long enough distance from the multilevel parking area(s), as these vehicles may be considered to be more easily located without a need for requesting further details as to their parking positions.

The level request message may be transmitted at any arbitrary time instant; for instance at a predetermined time instant and/or at predetermined time intervals. Moreover, the level request message may be transmitted any arbitrary number of times, for instance 1-5 times, and furthermore for instance at 1-180 minutes intervals. A potential response to the level request message may prevent further transmissions of the level request message.

According to an example, transmitting a level request message to a user device associated with the at least first parked vehicle, may comprise transmitting a level request message to a user device associated with the at least first parked vehicle at a predetermined time and/or time instant prior to a planned delivery of a delivered service to the at least first vehicle. Thereby, a message is submitted to a user device of the parked vehicle(s) at a predetermined time of day and/or at a predetermined time ahead of a planned delivery. Accordingly, should a planned delivery to a second parked vehicle differ in time from a planned delivery to a first parked vehicle, then the level request message may be transmitted to a user device associated with the first parked vehicle at a first time instant, whereas to a user device of the second parked vehicle, the level request message may be transmitted at a second time instant. The predetermined time instant may be arbitrarily selected, for instance approximately 5 minutes-5 hours prior to a planned delivery, and adapted to the situation at hand. For instance, the longer in advance—prior to the planned delivery—the level request message is submitted to the user device, the longer time provided for receiving a potential response from the user device and for planning the delivery in further detail. Concurrently, the shorter in advance—prior to the planned delivery—the level request message is submitted to the user device, the more likely may it be that the associated vehicle remains parked where specified.

The expression "user device associated with the at least first parked vehicle" may refer to a "user device associated with, registered to, in possession of and/or used by an owner and/or user of the at least first parked vehicle", and/or a "user device registered and/or specified to be associated with the at least first parked vehicle". The "owner" and/or "user" may for instance refer to a person accountable for the vehicle, or a person in possession of "constant" or "continuous" access rights to the vehicle. The "user device" may be any arbitrary electronic unit which is capable of communicating with other units, and which is adapted to receive the level request message. The "user device" may hence, for instance, be represented by a stationary computer or a mobile user equipment, for instance a mobile terminal or wireless terminal, a mobile phone or smart phone, a computer such as e.g., a laptop, a Personal Digital Assistant (PDA) or tablet computer, sometimes referred to as a surf plate, with wireless capability, or for example, a portable, pocket-storable, hand-held, computer-comprised mobile device. Moreover, the user device may be comprised in, integrated with and/or connected to the at least first parked vehicle, and/or an infotainment system thereof. Additionally or alternatively, "user device" may refer to "user entity", which user entity may comprise and/or be represented by an identity address—e.g., an email address, phone number and/or the like—associated with, specified by and/or registered to the owner and/or user of the vehicle.

"Transmitting" a level request message may refer to "submitting", "sending", and/or "transmitting wirelessly, electronically and/or digitally" a level request message. The level request message may be transmitted directly from the vehicle locating system to the user device, or, alternatively, for instance indirectly via the intermediate system discussed above, to the user device. The level request message may, in the latter case, to some extent be amended in the intermediate system to suit a possible differing communication format between the intermediate system and the user device, as compared to the communication format between the vehicle locating system and the intermediate system. Furthermore, the level request message may, should it be routed via the intermediate system, be amended in the intermediate system to comprise a subset and/or extension of its content prior to being transmitted to the user device.

The level request message may for instance be represented by a push message, and further for instance be comprised in at least one Short Message Service, SMS, message, at least one email, a corresponding type of message, and/or a successor of any of the foregoing. Thereby, a generic, commonly implemented message format may be utilized for submission of the level request message. The referred to "corresponding type" may refer to a message of a generic format, or a message of a customized format. The level request message may for instance be addressed and/or directed to the identity address discussed above, i.e. for instance addressed and/or directed to an email address, phone number and/or the like associated with, specified by and/or registered to the owner and/or user of the vehicle, which identity address may be associated with, and/or accessible from, the user device.

According to an example, the vehicle locating system may transmit a level request message to a user device associated with the at least first parked vehicle, prompting a user of the user device to indicate a level on which the vehicle is parked, and optionally the parking space in which the vehicle is parked on that level. Thereby, the user of the user device may be informed of that the vehicle is parked in an area where the vehicle may be difficult to find, and that input is requested from the user.

According to another example, rather than transmitting a message prompting a user of the user device to indicate a level on which the vehicle is parked, the vehicle locating system may transmit a level request message to a user device associated with the at least first parked vehicle, prompting the user device to transmit a response to indicate a level on which the vehicle is parked, and optionally the parking space in which the vehicle is parked on that level. Thereby, the user device may be informed of that the vehicle is parked in an area where the vehicle may be difficult to find, and that input is requested from the user device. The user device may for instance have stored thereon, be adapted to determine and/or derive a level on which the vehicle is parked in any arbitrary manner known in the art, e.g., by means of combining one or more of a pressure sensor, an altitude detector, dead reckoning etc., and be adapted to automatically provide said determined and/or derived parking level upon reception of the level request message.

According to yet another example, the level request message may comprise a parking level known by the vehicle locating system to have been previously used and/or commonly used by the at least first parked vehicle and/or by a user of the user device associated with the at least first parked vehicle. The assumed parking level may then subsequently may be confirmed or denied by the user device and/or by a user thereof.

Optionally, the vehicle locating system may map the estimated vehicle position on a digital map. Moreover, the vehicle locating system may identify a mapped multilevel parking area on the digital map. The vehicle locating system then determines that the mapped estimated vehicle position is comprised in, or is in the vicinity of, the mapped multilevel parking area. Thereby, by mapping the determined estimated vehicle position of the at least first parked vehicle onto a digital map, such as a visualized digital map, and further by comparing the mapped vehicle position to a multilevel parking area identified as such mapped onto said digital map, the vehicle locating system may determine whether or not the mapped vehicle position lies within or nearby the mapped multilevel parking area.

The "digital map" may at least partially be derived from, be associated with and/or be based on the digital map data and/or geographical data discussed above. Moreover, the digital map may, for instance, comprise and/or be represented by a "web map" and/or a map delivered by geographical information systems (GIS), such as for instance commercially available Google Maps or Google Earth, and/or an equivalent or a successor thereof. The determined estimated vehicle position(s) of one or more parked vehicle(s) may be mapped onto the digital map. Subsequently, the expression "mapped" (estimated) vehicle position may throughout this disclosure relate to the determined estimated geographical vehicle position of the at least first parked vehicle as represented on the digital map. Correspondingly, the expression "mapped" multilevel parking area may throughout this disclosure relate to the geographical area of the multilevel parking area as represented on the digital map. Furthermore, the expression "identifying" a multilevel parking area on the digital map may refer to "determining" and/or "deriving" a multilevel parking area on the digital map.

According to an example, the vehicle locating system may identify a multilevel parking area on the digital map, by identifying an interactively provided marked area on the digital map. Thereby, by determining that there is an interactively provided marked area on the—e.g., visualized—digital map, an area of the digital map, which area in advance has been interactively marked, e.g., highlighted and/or encircled, for instance by human interaction, is identified to represent a (mapped) multilevel parking area. Accordingly, the mapped multilevel parking area may be identified as such, in that an area on the digital map has been interactively marked.

Optionally, the vehicle locating system may receive a level response message from the user device, which level response message indicates at least a level on which the at least first vehicle is parked. Thereby, by reception of a level response message indicating the parking level on which the at least first vehicle is parked, the vehicle locating system may be informed of a greater detailed location of the at least first parked vehicle, and optionally, of details concerning the vehicle itself, such as its make, model, color and/or registration number subsequently facilitating finding the at least first vehicle.

"Receiving" a level response message may refer to "accepting" and/or "receiving wirelessly, electronically and/or digitally" a level response message. The level response message may be received directly from the user device, or, alternatively, for instance indirectly via the intermediate system discussed above. The level response message may, in the latter case, to some extent be amended in the intermediate system to suit a possible differing communication format between the intermediate system and the user device, as compared to the communication format between the vehicle locating system and the intermediate system. The level response message may, similarly to the level request message discussed above, for instance be represented by a push message, and further for instance be comprised in at least one Short Message Service, SMS, message, at least one email, a corresponding type of message, and/or a successor of any of the foregoing.

The expression of the level response message "indicating" at least a level on which the at least first vehicle is parked, may refer to the level response message "comprising" and/or "comprising information related to" at least a level on which the at least first vehicle is parked. Furthermore, the expression indicating at least a level on which the at least first vehicle "is parked", may refer to indicating at least a level on which the at least first vehicle "is determined, reported, stated, considered, and/or alleged to be parked". Moreover, "at least" may refer to that the level response message additionally may comprise further information related to the location of the at least first parked vehicle, for instance a section of the parking level and/or one or more hints which may make finding the at least first vehicle less challenging, such as e.g., "to the right", "to the left", "in the corner", "behind the post", "south", "east", "southeast" etc. According to an example, the level response message may comprise a confirmation on an assumed parking level optionally indicated by the level request message; thus for instance "yes", "correct", "ack" and/or the like.

Optionally, the vehicle locating system may transmit a level indication message to an operator device associated with a service provider adapted to carry out a delivered service to the at least first vehicle while being unattended, which level indication message indicates at least the level. Thereby, by submitting a level indication message indicating at least the level on which the at least first vehicle is parked as indicated in the level response message, to an operator device of a service provider about to deliver a delivery service to the at least first vehicle, an approach is provided which enables the service provider to in an efficient manner more easily locate the at least first parked vehicle situated where it potentially may be difficult to find.

The expression "operator device associated with a service provider adapted to carry out a delivered service to the at least first vehicle while being unattended" may refer to an "operator device associated with, registered to , in possession of and/or used by a service provider adapted to carry out a delivered service to the at least first vehicle while being unattended", and/or an "operator device associated with, registered to, in possession of and/or used by an operator of a service provider adapted to carry out a delivered service to the at least first vehicle while being unattended". The "operator" may, as previously discussed, for instance refer to one or more persons performing the delivered service, such as e.g., a delivery man, mechanic, or the like. The "operator device" may be any arbitrary electronic unit which is capable of communicating with other units, and which is adapted to receive the level indication message. The "operator device" may hence, for instance, be represented by a stationary computer or a mobile user equipment, for instance a mobile terminal or wireless terminal, a mobile phone or smart phone, a computer such as e.g., a laptop, a Personal Digital Assistant (PDA) or tablet computer, sometimes referred to as a surf plate, with wireless capability, or for example, a portable, pocket-storable, hand-held, computer-comprised mobile device. Moreover, the operator device may be comprised in, integrated with and/or connected to a vehicle of the service provider, and/or an infotainment system of said vehicle. Additionally or alternatively, "operator device" may refer to "operator entity", which operator entity may comprise and/or be represented by an identity address—e.g., an email address, phone number and/or the like—associated with, specified by and/or registered to the service provider and/or the operator.

The level indication message may be transmitted at any arbitrary time instant subsequent receiving the level response message. "Transmitting" a level indication message may refer to "submitting", "sending", and/or "transmitting wirelessly, electronically and/or digitally" a level indication message. The level indication message may be transmitted directly from the vehicle locating system to the operator device, or, alternatively, for instance indirectly via the intermediate system discussed above, to the operator device. The level indication message may, in the latter case, to some extent be amended in the intermediate system to suit a possible differing communication format between the intermediate system and the operator device, as compared to the communication format between the vehicle locating system and the intermediate system. Furthermore, the level indication message may comprise a subset of the content of the level response message, or an extension thereof. The level indication message may, similarly to the level request message and/or level response message discussed above, for instance be represented by a push message, and further for instance be comprised in at least one Short Message Service, SMS, message, at least one email, a corresponding type of message, and/or a successor of any of the foregoing.

The expression of the level indication message "indicating" at least the level, may refer to the level indication message "comprising" and/or "comprising information related to" at least the level on which the at least first vehicle is parked as indicated by the level response message. Moreover, "at least" may refer to that the level indication message additionally may comprise further information related to the location of the at least first parked vehicle, for instance the previously discussed exemplifying section of the parking level and/or one or more hints which may make finding the at least first vehicle less challenging, such as e.g., "to the right", "to the left", "in the corner", "behind the post", "south", "east", "southeast" etc.

According to an example, the operator device may be considered to be part of a system, which system in addition to the operator device comprises the vehicle locating system.

Optionally, the vehicle locating system may update a digital level attribute associated with the estimated vehicle position, with at least the level. Thereby, by updating a digital level attribute associated with the—e.g., mapped—vehicle position, with at least the parking level provided via the level response message, a more detailed location of the at least first parked vehicle situated where it potentially is difficult to find, is digitally stored and subsequently accessible. Accordingly, the level attribute, and subsequently the parking level of the at least first parked vehicle, may be electronically and/or digitally derived as suitable for the situation at hand. For instance, the parking level may be indicated visually—e.g., by text or numbers—along with the mapped vehicle position of the at least first parked vehicle, on the digital map, and/or be derivable when the mapped vehicle position of the at least first parked vehicle is interactively selected, highlighted and/or marked on the digital map. The digital level attribute may be updated with a subset of, the exact content of, and/or an extension of the content of the level response message, and or be derived therefrom. Moreover, optionally, the digital level attribute may comprise history data of a previous parking level used—for instance frequently—by the at least first parked vehicle and/or by a user of the user device associated with the at least first parked vehicle.

"Updating" a digital level attribute may refer to "changing" and/or "setting" a digital level attribute. Furthermore, the expression digital level "attribute" may refer to digital level "property" and/or "content". Moreover, the expression of updating a digital level attribute "associated with" the estimated vehicle position may refer to updating a digital level attribute "partly representing" and/or "indicating a reported parking level of" the estimated vehicle position and/or the mapped vehicle position.

Optionally, the vehicle locating system may define at least a first multilevel parking area on a digital map. Thereby, in analyzing the digital map, one or more areas on the digital map are determined to represent—e.g., mapped—multilevel parking areas, and said one or more areas are marked as such. Defining—and/or marking—at least a first multilevel parking area, may be represented by associating at least a portion of the area, the exact area and/or an extended area of the at least first mapped multilevel parking area with an identifier distinguishing the multilevel parking area from other areas and/or objects covered in the digital map data. For instance, said identifier may comprise one or more of a property, attribute, content or the like, pinpointing and/or marking the multilevel parking area as such. The expression "defining" at least a first multilevel parking area on a digital map may refer to "marking", "highlighting", "encompassing" and/or "encircling" at least a first multilevel parking area on a digital map.

Optionally, the vehicle locating system may define at least a first multilevel parking area on a digital map, by detecting an interactively provided marked area on the digital map. Thereby, by defining at least a first multilevel parking area by detection of an interactively provided marked area on the—e.g., visualized—digital map, an area on the digital map determined to have been interactively marked, e.g., highlighted, encircled and/or mapped, for instance by human interaction, is defined to represent a—e.g., mapped—multilevel parking area. Accordingly, the identifier discussed above distinguishing a multilevel parking area from other areas and/or objects covered in the digital map data, may here comprise the area being an interactively provided marked area.

"Defining" at least a first multilevel parking area may refer to "determining" and/or "pinpointing" at least a first multilevel parking area, whereas "detecting" an interactively provided marked area on the digital map may refer to "determining" an interactively provided marked area on the digital map.

According to a second aspect of embodiments herein, the object is achieved by a vehicle locating system configured for locating at least a first parked vehicle situated where it potentially is difficult to find, e.g., a vehicle located in a multilevel parking area and which vehicle further may be adapted for receipt of a delivered service while being unattended. The vehicle locating system comprises a position determining unit adapted for determining an estimated geographical vehicle position of the at least first parked vehicle. Furthermore, the vehicle locating system comprises a match determining unit adapted for determining based on digital map data that the estimated vehicle position is comprised in, or is in in the vicinity of, a multilevel parking area, e.g., by comparing the determined estimated position of the parked vehicle to a multilevel parking area identified in digital map data and determining that said estimated vehicle position is comprised in, or is in the vicinity of, the multilevel parking area. Moreover, the vehicle locating system comprises a message transmitting unit adapted for transmitting a level request message to a user device associated with the at least first parked vehicle, and optionally a request for a position on a particular level, such as a request for a parking space number, for instance at a predetermined time and/or time instant prior to a planned delivery of a delivered service to the at least first vehicle. The level request message may for instance prompt a user of the user device to indicate a level on which the vehicle is parked, and/or prompt the user device to transmit a response to indicate a level on which the vehicle is parked.

Optionally, the vehicle locating system may further comprise a mapping unit adapted for mapping the estimated vehicle position on a digital map. The vehicle locating system may further comprise an identifying unit adapted for identifying a mapped multilevel parking area on the digital map. The match determining unit is then further adapted for determining that the mapped vehicle position is comprised in, or is in the vicinity of, the mapped multilevel parking area. According to an example, the identifying unit may be adapted for identifying a mapped multilevel parking area on the digital map, by identifying an interactively provided marked area on the digital map.

Optionally, the vehicle locating system may comprise a message receiving unit adapted for receiving a level response message from the user device, which level response message indicates at least a level on which the at least first vehicle is parked; for instance a level on which the at least first vehicle is determined, reported, stated, considered, and/or alleged to be parked.

Optionally, the message transmitting unit may further be adapted for transmitting a level indication message to an operator device associated with a service provider adapted to carry out a delivered service to the at least first vehicle while being unattended, which level indication message indicates at least said level; for instance said level as indicated by the level response message.

Optionally, the vehicle locating system may comprise an updating unit adapted for updating a digital level attribute associated with the—e.g., mapped—estimated vehicle position, with at least the level; for instance the level as indicated by the level response message.

Optionally, the vehicle locating system may further comprise a defining unit adapted for defining at least a first multilevel parking area on a digital map.

Optionally, the defining unit may further be adapted for defining at least a first multilevel parking area on a digital map, by detecting an interactively provided marked area on the digital map.

Similar advantages as those mentioned in the foregoing in relation to the first aspect correspondingly apply to the second aspect, which is why these advantages are not further discussed.

According to a third aspect of embodiments herein, the object is achieved by a computer program product comprising a computer program containing computer program code means arranged to cause a computer or a processor to execute the steps of the vehicle locating system discussed above, stored on a computer-readable medium or a carrier wave. Yet again, similar advantages as those mentioned in the foregoing in relation to the first aspect correspondingly apply to the third aspect, which is why these advantages are not further discussed.

BRIEF DESCRIPTION OF THE DRAWINGS

Various aspects of non-limiting embodiments according to the disclosure, including particular features and advantages, will be readily understood from the following detailed description and the accompanying drawings, in which.

DETAILED DESCRIPTION

Figure 1:
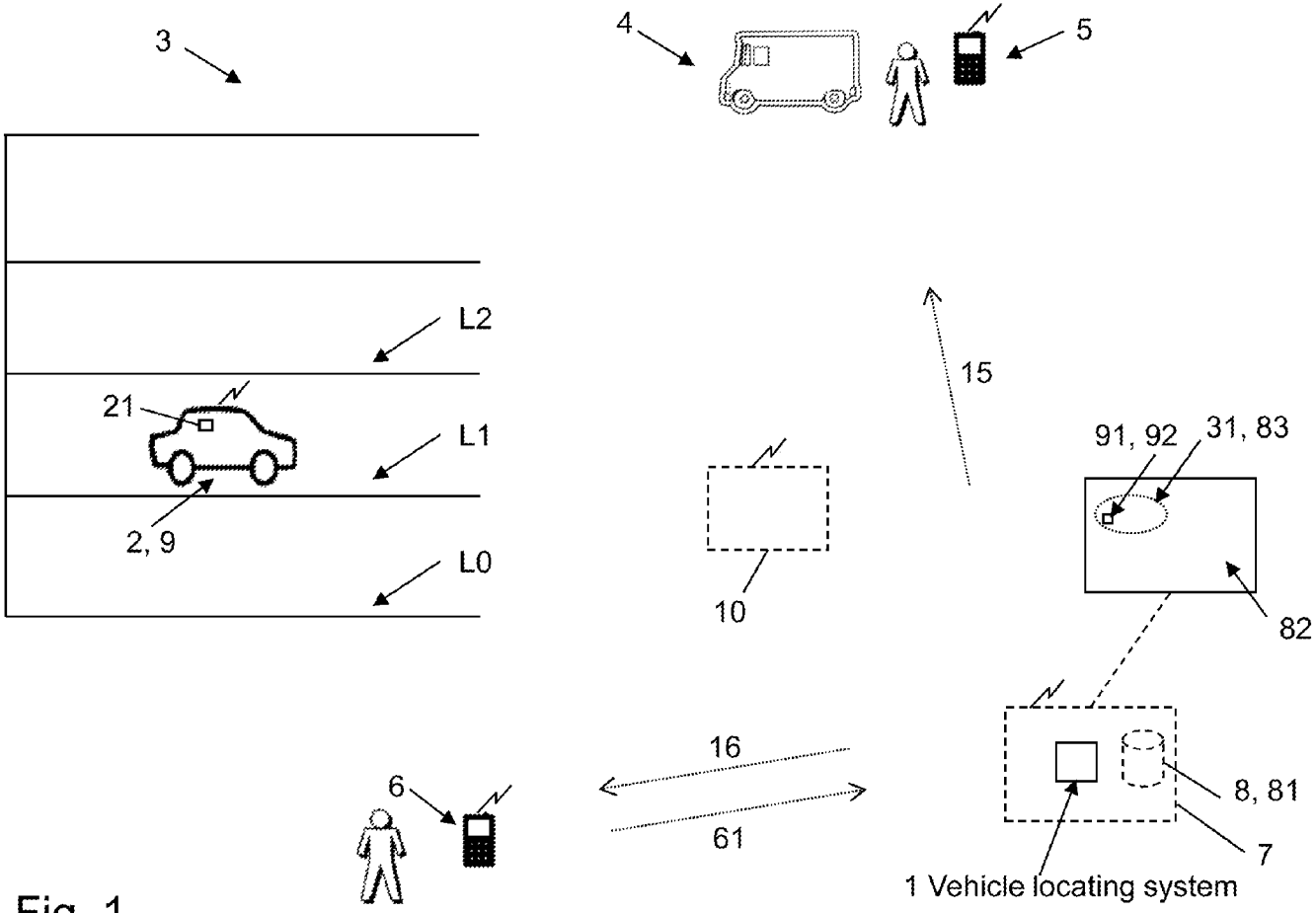
FIG. 1 illustrates an exemplifying vehicle locating system according to embodiments of the disclosure.

Non-limiting embodiments of the present disclosure will now be described more fully hereinafter with reference to the accompanying drawings. This disclosure may, however, be embodied in many different forms and should not be construed as limited to the embodiments set forth herein. Like reference characters refer to like elements throughout. Dashed lines of some boxes in the figures indicate that these units or actions are optional and not mandatory.

In the following, according to embodiments herein which relate to a vehicle locating system and a method therein for locating at least a first parked vehicle situated where it potentially is difficult to find, there will be disclosed an approach which supports finding one or more parked vehicles which e.g., vertical parking position(s) may be challenging to determine.

Referring now to the figures and FIG. 1 in particular, there is illustrated an exemplifying vehicle locating system 1 according to embodiments of the disclosure. The vehicle locating system 1 is configured for locating at least a first parked vehicle 2 situated where it may be difficult to find. The first parked vehicle 2, which optionally comprises a positioning system 21, is here comprised in a multilevel parking area 3. The multilevel parking area 3 comprises a plurality of parking levels L0, L1, L2, etc., and in the shown embodiment, the at least first vehicle 2—here a passenger car—is parked on the exemplifying first parking level L1.

The first parked vehicle 2 is here represented by a vehicle adapted for receipt of a delivered service while being unattended. A service provider 4, here represented by a delivery vehicle and an operator, is in the shown embodiment adapted to carry out the delivered service to the at least first vehicle 2 while being unattended. An operator device 5 is here associated with the service provider 4, which operator device 5 for instance may be represented by an exemplifying mobile phone, and which operator device 5 further for instance may be carried by the operator and/or be comprised in the delivery vehicle.

Associated with the at least first parked vehicle 2 is a user device 6, here an exemplifying mobile phone. The user device 6 is in the shown embodiment carried by a user—here the owner—of the at least first parked vehicle 2, who is depicted to be elsewhere than in the at least first vehicle 2, for instance at work, thus leaving the first vehicle 2 unattended.

Moreover depicted in FIG. 1 is an optional server 7, comprising the vehicle locating system 1 and an optional digital map data database 8. The map data database 8 comprises digital map data 81. Additionally shown in the exemplifying embodiment is a digital map 82 which may be derived from the digital map data 81, which digital map 82 here is visualized on a digital display such as a computer display (now shown). Here, the digital map 82 comprises the exemplifying commercially available Google Maps. Displayed on the digital map 82 is in the shown embodiment a mapped multilevel parking area 31, representing the multilevel parking area 3 in which the first parked vehicle 2 is situated. The mapped multilevel parking area 31 here essentially overlaps with a marked area 83 on the digital map 82, which marked area 83 has been interactively provided in advance; for instance by a human being having marked, encircled, highlighted, mapped and/or indicated an area 83 essentially coinciding with the mapped multilevel parking area 31 on the digital map 82.

Further displayed on the digital map 82 is a mapped estimated vehicle position 91, reflecting an estimated geographical vehicle position 9, e.g., horizontal vehicle position, of the first parked vehicle 2. The mapped estimated vehicle position 91 is in the shown embodiment comprised in, or in the vicinity of, the mapped multilevel parking area 31. A digital level attribute 92 is associated with the estimated vehicle position 9 and/or with the mapped vehicle position 91, and the level attribute 92 may be updated with—and/or comprise—at least a parking level L0, L1, L2 on which the at least first vehicle 2 may be parked, as will be described in greater detail further on in this description.

The vehicle locating system 1 is configured for transmitting a level request message 16 to the user device 6, optionally configured for receiving a level response message 61 from the user device 6, and moreover optionally configured for transmitting a level indication message 15 to the operator device 5, as will be explained in greater detail further on. The vehicle locating system 1 may moreover comprise, be comprised in and/or be able to communicate with an optional intermediate system 10. The intermediate system 10, which here is represented by Volvo On Call, may be adapted to communicate with vehicles 2 and/or hold updated positions 9 of the vehicles 2.

As further shown in FIG. 2, which depicts a schematic block diagram illustrating an exemplifying vehicle locating system 1 according to embodiments of the disclosure, the vehicle locating system 1 comprises a position determining unit 102, a match determining unit 105 and a message transmitting unit 106, all of which will be described in greater detail further on. The vehicle locating system 1 may optionally further comprise a defining unit 101, a mapping unit 103, an identifying unit 104, a message receiving unit 107, and/or an updating unit 109, all of which likewise will be described in greater detail further on. Furthermore, the embodiments herein for locating at least a first parked vehicle 2 situated where it potentially is difficult to find, may be implemented through one or more processors, such as a processor 110, here denoted CPU, together with computer program code for performing the functions and actions of the embodiments herein. Said program code may also be provided as a computer program product, for instance in the form of a data carrier carrying computer program code for performing the embodiments herein when being loaded into the vehicle locating system 1. One such carrier may be in the form of a CD ROM disc. It is however feasible with other data carriers such as a memory stick. The computer program code may furthermore be provided as pure program code on a server and downloaded to the vehicle locating system 1.

The vehicle locating system 1 may further comprise a memory 111 comprising one or more memory units. The memory 111 may be arranged to be used to store e.g., information, and further to store data, configurations, schedulings, and applications, to perform the methods herein when being executed in the vehicle locating system 1. Furthermore, the optional defining unit 101, the position determining unit 102, the optional mapping unit 103, the optional identifying unit 104, the match determining unit 105, the message transmitting unit 106, the optional message receiving unit 107, the optional updating unit 109, the optional processor 110, and/or the optional memory 111 may for instance be implemented in one or several arbitrary servers 7 and/or clouds.

Those skilled in the art will also appreciate that the optional defining unit 101, the position determining unit 102, the optional mapping unit 103, the optional identifying unit 104, the match determining unit 105, the message transmitting unit 106, the optional message receiving unit 107, and/or the optional updating unit 109 described above, and which will be described in more detail later on in this description, may refer to a combination of analog and digital circuits, and/or one or more processors configured with software and/or firmware, e.g., stored in a memory such as the memory 111, that when executed by the one or more processors such as the processor 110 perform as will be described in more detail later on. One or more of these processors, as well as the other digital hardware, may be included in a single ASIC (Application-Specific Integrated Circuitry), or several processors and various digital hardware may be distributed among several separate components, whether individually packaged or assembled into a SoC (System-on-a-Chip).

Figure 2:
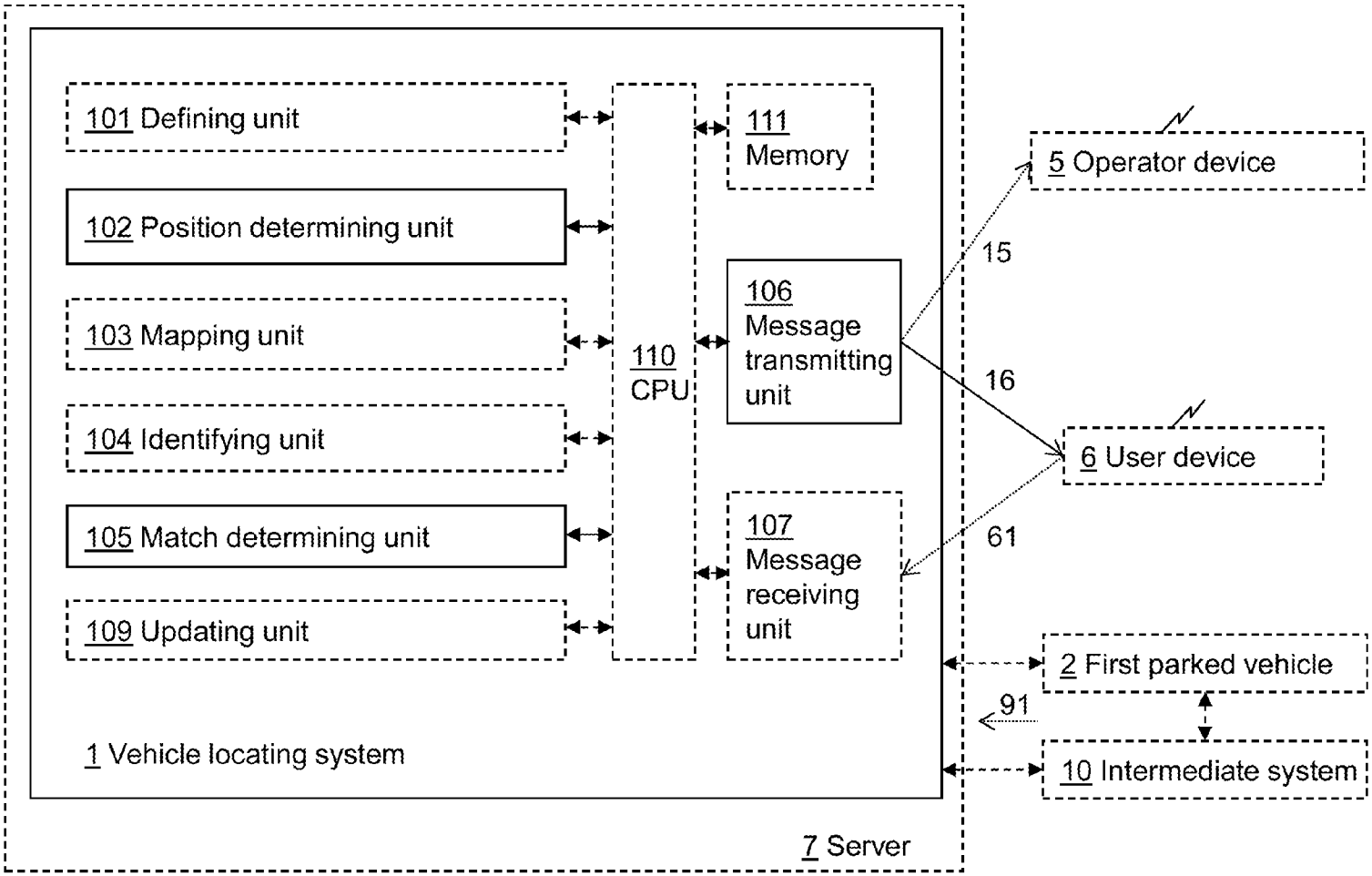
FIG. 2 is a schematic block diagram illustrating an exemplifying vehicle locating system according to embodiments of the disclosure.
Figure 3:
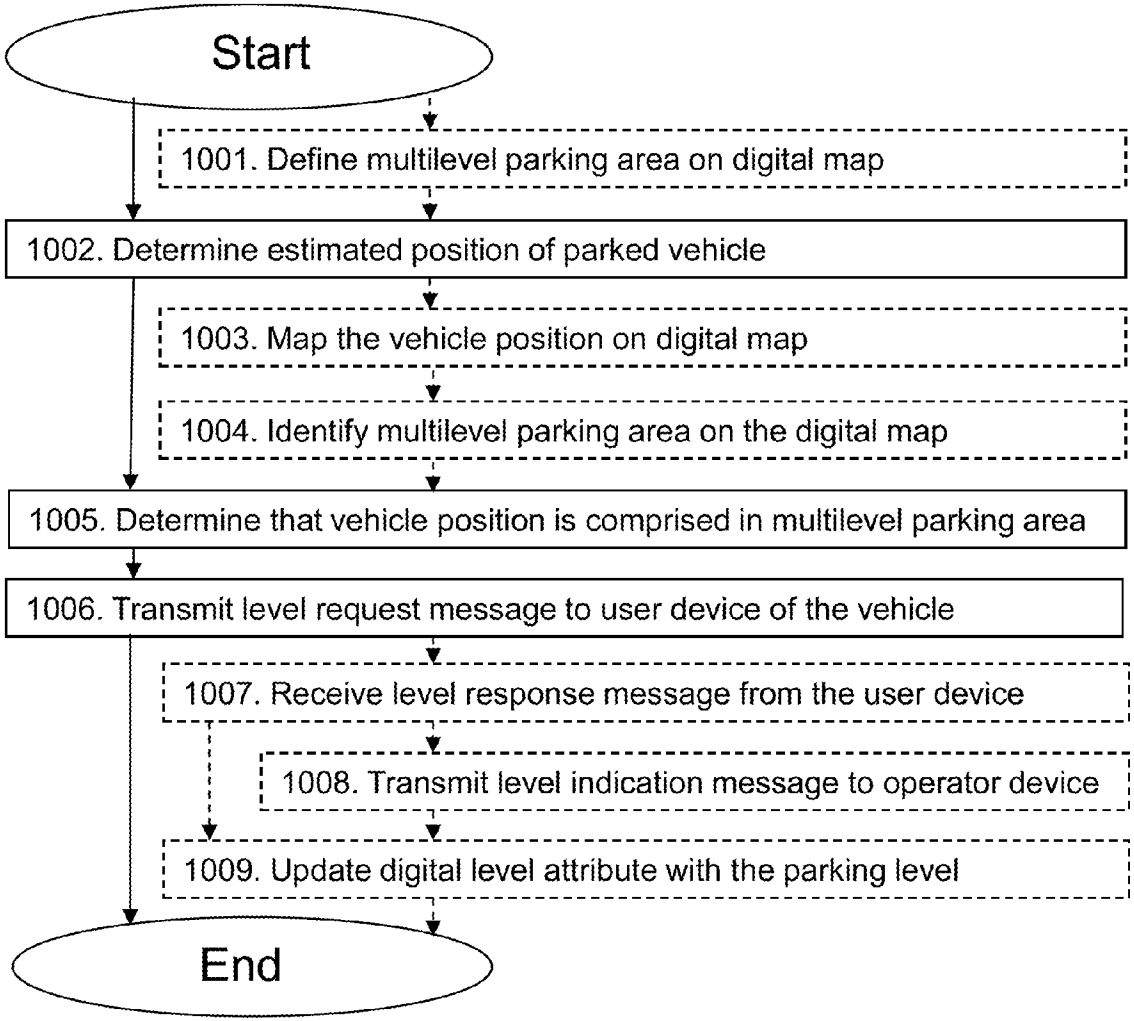
FIG. 3 is a flowchart depicting exemplifying method steps of a vehicle locating system according to embodiments of the disclosure.

FIG. 3 is a flowchart depicting exemplifying method steps of a vehicle locating system 1 according to embodiments of the disclosure. The method is set out to locate at least the first parked vehicle 2 situated where it potentially is difficult to find. The exemplifying method, which may be continuously repeated, comprises the following actions discussed with support from FIGS. 1 and 2. The actions may be taken in any suitable order, and even be performed simultaneously where applicable. For instance, Actions 1003 and 1004, and/or Actions 1008 and 1009 may be taken in a reverse order, and/or be performed simultaneously.

Action 1001

In optional Action 1001, the vehicle locating system 1 may define at least a first multilevel parking area 3 on the digital map 82. Correspondingly, the defining unit 101 may be adapted for defining at least a first multilevel parking area 3 on the digital map 82.

Thus, as shown with support from FIGS. 1 and 2, in analyzing the digital map 82, one or more areas on the digital map 82 may be determined to represent—e.g., mapped—multilevel parking areas 3, and said one or more areas are marked as such, for instance by means of an indicator.

Optionally, defining at least a first multilevel parking area 3 on the digital map 82, may comprise the vehicle locating system 1 detecting the interactively provided marked area 83 on the digital map 81. Correspondingly, the defining unit 101 may further be adapted for defining at least a first multilevel parking area 3 on the digital map 82, by detecting the interactively provided marked area 83 on the digital map 82.

Thus, as shown with support from FIGS. 1 and 2, by defining at least a first multilevel parking area 3 by detection of the interactively provided marked area 83 on the—e.g., visualized—digital map 82, an area 83 on the digital map 82 determined to have been interactively marked, e.g., highlighted, encircled and/or mapped, for instance by human interaction, is defined to represent a—e.g., mapped—multilevel parking area 3.

Action 1002

In Action 1002, the vehicle locating system 1 determines the estimated geographical position 9 of the at least first parked vehicle 2. Correspondingly, the position determining unit 102 is adapted for determining the estimated geographical position 9 of the at least first parked vehicle 2.

Thus, as shown with support from FIGS. 1 and 2, an approximate vehicle position 9 of the at least first parked vehicle 2 is established, for instance with support from the positioning system 21 of the first parked vehicle 2, and/or with support from the intermediate system 10.

Action 1003

In optional Action 1003, the vehicle locating system 1 may map the estimated vehicle position 9 on the digital map 82. Correspondingly, the mapping unit 103 may be adapted for mapping the estimated vehicle position 9 on the digital map 82.

Action 1004

Following upon Action 1003, in optional Action 1004, the vehicle locating system 1 may identify the mapped multilevel parking area 31 on the digital map 82. Correspondingly, provided that the mapping unit 103 is adapted for mapping the estimated vehicle position 9 on the digital map 82, then the identifying unit 104 may be adapted for identifying the mapped multilevel parking area 31 on the digital map 82.

According to an example, the vehicle locating system 1 may identify the mapped multilevel parking area 31 on the digital map 82, by identifying the interactively provided marked area 83 on the digital map 82. Correspondingly, the identifying unit 104 may be adapted for identifying the mapped multilevel parking area 31 on the digital map 82, by identifying the interactively provided marked area 83 on the digital map 82.

Thus, as shown with support from FIGS. 1 and 2, by determining that there is an interactively provided marked area 83 on the—e.g., visualized—digital map 82, an area 83 of the digital map 82, which area 83 in advance has been interactively marked, e.g., highlighted and/or encircled, for instance by human interaction, is identified to represent a (mapped) multilevel parking area 31. Accordingly, the mapped multilevel parking area 31 may be identified as such, in that an area 83 on the digital map 82 has been interactively marked.

Action 1005

In Action 1005, the vehicle locating system 1 determines—based on the digital map data 81—that the estimated vehicle position 9 is comprised in, or is in the vicinity of, the multilevel parking area 3. Correspondingly, the match determining unit 105 is adapted for determining—based on the digital map data 81—that the estimated vehicle position 9 is comprised in, or is in in the vicinity of, the multilevel parking area 3.

Thus, as shown with support from FIGS. 1 and 2, it is established by comparison of the determined estimated position 9 of the parked vehicle 2 to the multilevel parking area 3 identified in the digital map data 81, that the estimated vehicle position 9 is within, or close to, the parking area 3 having more than one parking level L0, L1, L2 etc. Accordingly, the at least first parked vehicle 2 is deemed situated in an area 3 where the vehicle 2 may be challenging to find. Thus, by for instance determining based on digital map 81 data which one or more vehicles 2 out of a plurality of vehicles—for instance adapted for receipt of a respective delivered service—that are comprised in, or in the vicinity of, a multilevel parking area 3, vehicles 2 which are deemed to be situated in an area 3 where they may be difficult to find, are identified.

In the scenario of the vehicle locating system 1 optionally identifying the mapped multilevel parking area 31 on the digital map 82, as described in Action 1004, then determining based on digital map data 81 that the estimated vehicle position 9 is comprised in, or is in the vicinity of, the multilevel parking area 3, may comprise determining that the mapped estimated vehicle position 91 is comprised in, or is in the vicinity of, the mapped multilevel parking area 31. Correspondingly, in the scenario of the mapping unit 103 optionally being adapted for mapping the estimated vehicle position 9 on the digital map 82, and the identifying unit 104 optionally being adapted for identifying the mapped multilevel parking area 31 on the digital map 82, then the match determining unit 105 may further be adapted for determining that the mapped estimated vehicle position 91 is comprised in, or is in the vicinity of, the mapped multilevel parking area 31.

Thus, as shown with support from FIGS. 1 and 2, by mapping the determined estimated vehicle position 9 of the at least first parked vehicle 2 onto a digital map 82, such as a visualized digital map, and further by comparing the mapped vehicle position 91 to the multilevel parking area 31 identified as such mapped onto the digital map 82, the vehicle locating system 1 may determine whether or not the mapped vehicle position 91 lies within or nearby the mapped multilevel parking area 31.

Action 1006

In Action 1006, the vehicle locating system 1 transmits the level request message 16 to the user device 6 associated with the at least first parked vehicle 2. Correspondingly, the message transmitting unit is adapted for transmitting the level request message 16 to the user device 6 associated with the at least first parked vehicle 2.

Thus, as shown with support from FIGS. 1 and 2, a respective message 16 may be submitted to each of a user device 6 of the one or more vehicles 2 parked in—or in the vicinity of—the multilevel parking area 3, which message 16 requests information related to on which parking level L0, L1, L2 etc. the associated vehicle 2 is parked. Accordingly, said message 16 is submitted only to user devices 6 of vehicles 2 determined to be parked in—or in the vicinity of—a multilevel parking area 3, as these vehicles 2 are considered to be parked within or near an area 3 where they may be difficult to find.

Action 1007

In optional Action 1007, the vehicle locating system 1 may receive the level response message 61 from the user device 6, which level response message 61 indicates at least the level L1 on which the at least first vehicle 2 is parked. Correspondingly, the message receiving unit 107 may be adapted for receiving the level response message 61 from the user device 6, which level response message 61 indicates at least the level L1 on which the at least first vehicle 2 is parked.

Thus, as shown with support from FIGS. 1 and 2, by reception of a level response message 61 indicating the parking level L1 on which the at least first vehicle 2 is parked, the vehicle locating system 1 may be informed of a greater detailed location 9, L1 of the at least first parked vehicle 2, subsequently facilitating finding the at least first vehicle 2.

Action 1008

In optional Action 1008, the vehicle locating system 1 may transmit the level indication message 15 to the operator device 5 associated with the service provider 4 adapted to carry out a delivered service to the at least first vehicle 2 while being unattended. Correspondingly, the message transmitting unit 106 may furthermore be adapted for transmitting the level indication message 15 to the operator device 5 associated with the service provider 4 adapted to carry out a delivered service to the at least first vehicle 2 while being unattended. The level indication message 15 indicates at least the level L1, i.e. the parking level L1 as indicated by the level response message 61 from the user device 6 to the vehicle locating system 1.

Thus, as shown with support from FIGS. 1 and 2, by submitting a level indication message 15 indicating at least the level L1 on which the at least first vehicle 2 is parked, to the operator device 5 of the service provider 4 about to deliver a delivery service to the at least first vehicle 2, an approach is provided which enables the service provider 4 to in an efficient manner more easily locate the at least first parked vehicle 2 situated where it potentially may be difficult to find.

Action 1009

In optional Action 1009, the vehicle locating system 1 may update the digital level attribute 92 associated with the estimated vehicle position 9, with at least the level L1. Correspondingly, the updating unit may be adapted for updating the digital level attribute 92 associated with the estimated vehicle position 9, with at least the level L1.

Thus, as shown with support from FIGS. 1 and 2, by updating the digital level attribute 92 associated with the—e.g., mapped—vehicle position 9, 91, with at least the parking level L1 provided via the level response message 61, a more detailed location 9, L1 of the at least first parked vehicle 2 situated where it potentially is difficult to find, is digitally stored—e.g., in the memory 111—and subsequently accessible. Accordingly, the level attribute 92, and subsequently the parking level L1 of the at least first parked vehicle 2, may be electronically and/or digitally derived as suitable for the situation at hand. For instance, the parking level L1 may be indicated visually—e.g., by text or numbers—along with the mapped vehicle position 91 of the at least first parked vehicle 2, on the digital map 82, and/or be derivable when the mapped vehicle position 91 of the at least first parked vehicle 2 is interactively selected, indicated and/or marked on the digital map 82.

The person skilled in the art realizes that the present disclosure by no means is limited to the preferred embodiments described above. On the contrary, many modifications and variations are possible within the scope of the appended claims. It should furthermore be noted that the drawings not necessarily are to scale and the dimensions of certain features may have been exaggerated for the sake of clarity. Emphasis is instead placed upon illustrating the principle of the embodiments herein. Additionally, in the claims, the word "comprising" does not exclude other elements or steps, and the indefinite article "a" or "an" does not exclude a plurality.

While exemplary embodiments are described above, it is not intended that these embodiments describe all possible forms according to the disclosure. The words used in the specification are words of description rather than limitation, and it is understood that various changes may be made without departing from the spirit and scope of the disclosure. Additionally, the features of various implementing embodiments may be combined to form further embodiments according to the disclosure.

What is claimed is:

1. A method performed by a vehicle locating system comprising a processor and associated memory, the method for locating at least a first parked vehicle in a multilevel parking area, the vehicle locating system adapted to communicate directly or indirectly with the at least first parked vehicle, the method comprising:

deriving an estimated geographical vehicle position of the at least first parked vehicle;

determining based on digital map data that the estimated vehicle position is comprised in, or is in in the vicinity of, a multilevel parking area; and transmitting a level request message to a user device associated with a user of the at least first parked vehicle, prompting the user to indicate a level on which the at least first parked vehicle is parked.

2. The method according to claim 1 further comprising:

mapping the estimated vehicle position on a digital map; and identifying a mapped multilevel parking area on the digital map;

wherein the determining based on digital map data that the estimated vehicle position is comprised in, or is in the vicinity of, a multilevel parking area, comprises determining that the mapped estimated vehicle position is comprised in, or is in the vicinity of, the mapped multilevel parking area.

3. The method according to claim 1 further comprising:

receiving a level response message from the user device, the level response message indicating at least a level on which the at least first vehicle is parked.

4. The method according to claim 3 further comprising:
updating a digital level attribute associated with the estimated vehicle position, with at least the level.

5. The method according to claim 3 further comprising:
transmitting a level indication message to an operator device associated with a service provider adapted to carry out a delivered service to the at least first vehicle while being unattended, the level indication message indicating at least the level.

6. The method according to claim 5 further comprising:
updating a digital level attribute associated with the estimated vehicle position, with at least the level.

7. The method according to claim 1 further comprising:
defining at least a first multilevel parking area on a digital map.

8. The method according to claim 7 wherein the defining at least a first multilevel parking area on a digital map comprises detecting an interactively provided marked area on the digital map.

9. A vehicle locating system configured for locating at least a first parked vehicle in a multilevel parking area, the vehicle locating system adapated to communiate directly or indirectly with the at least first parked vehicle, the vehicle locating system comprising:
a position determining unit comprising a processor and associated memory, the position determining unit adapted for deriving an estimated geographical vehicle position of the at least first parked vehicle;
a match determining unit comprising a processor and associated memory, the match determining unit adapted for determining based on digital map data that the estimated vehicle position is comprised in, or is in in the vicinity of, a multilevel parking area; and
a message transmitting unit comprising a processor and associated memory, the message transmitting unit adapted for transmitting a level request message to a user device associated with a user of the at least first parked vehicle, prompting the user to indicate a level on which the at least first parked vehicle is parked.

10. The vehicle locating system according to claim 9 further comprising:
a message receiving unit adapted for receiving a level response message from the user device, the level response message indicating at least a level on which the at least first vehicle is parked.

11. The vehicle locating system according to claim 9 further comprising:
a mapping unit adapted for mapping the estimated vehicle position on a digital map; and
an identifying unit adapted for identifying a mapped multilevel parking area on the digital map;
wherein the match determining unit further is adapted for determining that the mapped estimated vehicle positon is comprised in, or is in the vicinity of, the mapped multilevel parking area.

12. The vehicle locating system according to claim 11 further comprising:
a message receiving unit adapted for receiving a level response message from the user device, the level response message indicating at least a level on which the at least first vehicle is parked.

13. The vehicle locating system according to claim 12 wherein the message transmitting unit further is adapted for:
transmitting a level indication message to an operator device associated with a service provider adapted to carry out a delivered service to the at least first vehicle while being unattended, the level indication message indicating at least the level.

14. The vehicle locating system according to claim 13 further comprising:
an updating unit adapted for updating a digital level attribute associated with the estimated vehicle position, with at least the level.

15. The vehicle locating system according to claim 9 further comprising:
a defining unit adapted for defining at least a first multilevel parking area on a digital map.

16. The vehicle locating system according to claim 15 wherein the defining unit further is adapted for defining at least a first multilevel parking area on a digital map, by detecting an interactively provided marked area on the digital map.

17. A non-transitory computer-readable medium having stored thereon computer program code for locating at least a first parked vehicle in a multilevel parking area, the program code for execution by a processor of a vehicle locating system, the vehicle locating system adapted to communicate directly or indirectly with the at least first parked vehicle, wherein the program code when executed by the processor of the vehicle locating system causes the vehicle locating system to:
derive an estimated geographical vehicle position of at least a first parked vehicle;
determine based on digital map data that the estimated vehicle position is comprised in, or is in in the vicinity of, a multilevel parking area; and
transmit a level request message to a user device associated with a user of the at least first parked vehicle, prompting the user to indicate a level on which the at least first parked vehicle is parked.

* * * * *